US006171008B1

(12) United States Patent
Ochsner

(10) Patent No.: US 6,171,008 B1
(45) Date of Patent: Jan. 9, 2001

(54) ALBUM LEAF

(75) Inventor: Gusti Ochsner, Schmerikon (CH)

(73) Assignee: Ochsner & Co. Ing. G Ochsner, Schmerikon (CH)

( * ) Notice: Under 35 U.S.C. 154(b), the term of this patent shall be extended for 0 days.

(21) Appl. No.: 09/059,462

(22) Filed: Apr. 14, 1998

(30) Foreign Application Priority Data

Oct. 18, 1997 (EP) ..... 97118116

(51) Int. Cl.[7] ..... B42F 13/00

(52) U.S. Cl. ..... 402/79; 281/22; 281/38; 283/101; 428/41.8

(58) Field of Search ..... 402/79; 281/38, 281/21.1, 15.1, 22; 283/101; 428/40.1, 41.4, 41.7, 42.2, 42.3, 41.8

(56) References Cited

U.S. PATENT DOCUMENTS 4,140,565 * 2/1979 Parker et al. ..... 281/22 X
5,030,491 * 7/1991 Shoesmith ..... 402/79 X
5,503,435 * 4/1996 Kline ..... 402/79 X
5,543,190 * 8/1996 Johnson et al. ..... 281/22 X
5,816,730 * 10/1998 Alspaw et al. ..... 281/22 X

* cited by examiner

*Primary Examiner*—Willmon Fridie, Jr.
(74) *Attorney, Agent, or Firm*—Evenson, McKeown, Edwards & Lenahan, P.L.L.C.

(57) ABSTRACT

The album leaf (1) of the present invention includes at least one adhesive layer (2) which is covered by a removable cover leaf (3). Prior to placing a photograph this cover leaf (3) can be simply removed and the photograph thereafter placed onto the adhesive agent area (2). Preferably, no additional mounting means are needed for placing the photographs onto the album leaf (1) and the manufacturing can proceed in a relatively simple manner and poses no extreme high demands regarding the precision.

10 Claims, 2 Drawing Sheets

ALBUM LEAF

BACKGROUND OF THE INVENTION

1. Field of the Invention

The present invention relates to an album leaf for receipt of planar pictures such as photographs or cards. It also relates to an album which comprises a plurality of such leaves.

2. Description of the Prior Art

In order to keep paper photographs in a representative manner it is common to use, for instance, photo albums. These albums are assembled commonly in form of album leaves which are bound together in a book like fashion, which leaves which consist of paper or cardboard and are separated from each other by, for instance, translucent thin separating sheets. The individual photographs can now be, for instance, glued onto these album leaves. For this task use is made of an adhesive or special small mounting flaps, which can be placed onto the album leaf in a self adhering manner and into which the corner areas of the photographs can be inserted. Further known are also mounting strips which stick at both of their surfaces and which can be placed in an adhering manner between the album leaf and the photographs. The drawback of these solutions is that, on the one hand auxiliary means are needed for the mounting of the photographs, and on the other hand a precise parallel alignment of the edges of the photographs relative to the edges of the album leaves is practically impossible due to the lack of a corresponding alignment aid, or is only possible at the cost of additional auxiliary devices.

Photo albums are known, furthermore, in which the separating leaves are not designed as separate leaves located between the album leaves proper, but rather as transparent foils connected in such a manner to the album leaf that pockets are formed which are accessible from one side only, into which the photographs can be inserted. Preferably, no additional mounting means are needed thereby. The manufacturing of such album leaves, however, requires a high precision. Specifically the connecting between the album leaves and the foil, which leads to high production costs, and the insertion of the photographs is often difficult when the pocket is of a close fitting size.

Great Britain patent document GB-PS 1 523 257 discloses, furthermore, for instance an album leaf on which two adhesive strips which are arranged parallel to each other are present on each side of the album leaf, onto which respective differing frames for the receipt of photographs can be placed in a removable manner. The photographs are, thereby, held by the frame or mounted therein, respectively. Two respective transparent partition leaves must, thereby, be placed between two adjacent album leaves, which, after the photographs or frames, respectively have been mounted, cover any respective adhesive areas not covered by the photographs or frames, respectively because otherwise the leaves of the album would remain clinging to each other. It has now been proven that the adhesive agents used for such applications, which form a releasable adhesive connection between only the partition leaves and the reverse sides of the frames, lead after a certain time to changes at the photographs themselves. Because specifically photo albums are designed for an extended time of storing photographs, such solutions can not be applied.

SUMMARY OF THE INVENTION

Hence, it is a general object of the present invention to provide a photo album leaf of the kind mentioned above onto which photographs can be deposited in a simple manner and which poses also for its production no high demands regarding the precision.

A further object is to provide a photo album leaf in which at least one area on at least one side of the leaf is provided with a contact adhesive, which area is completely covered by a release cover sheet which is detachable from the contact adhesive.

Thus, the photographs can be placed in a simple manner onto the contact adhesive areas after the easily removable release cover sheets have been removed. Accordingly, additional mounting devices for the photographs are advantageously avoided. The deposition of such adhesive areas can proceed mechanically in a simple manner; the corresponding machines can be of a simple design because no high demands are made regarding the precision of the positioning of the areas of the adhesives. Also, an adhesive agent can be advantageously used which is optimally designed for the photographs and which does not attack or discolor the photographic paper also after a prolonged time.

A further advantage is that the release cover sheet which covers the adhesive area can be made of a cellulose material, with only a small portion of silicate, in order to ensure the feature of an easy removal. By means of this the aspect of an environmentally harmless solution is also taken into consideration.

Still a further object of the invention is to provide a photo album which includes leaves structured in accordance with the present invention. Advantageously, common lightweight partition leaves are arranged between the individual album leaves.

DESCRIPTION OF THE PREFERRED EMBODIMENTS

Figure 1:
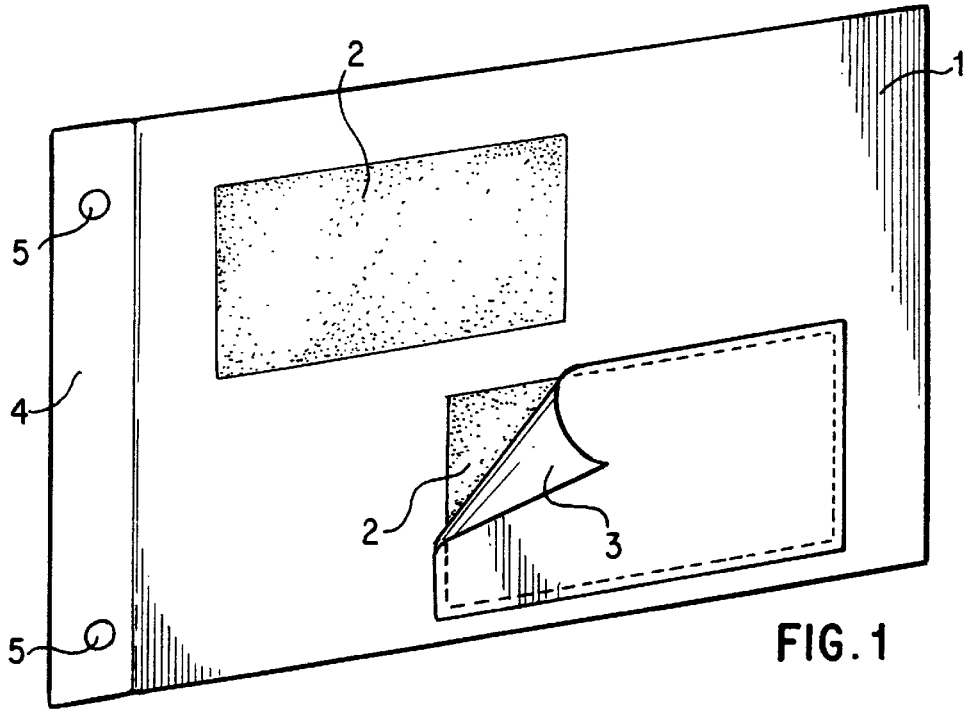
FIG. 1 is a view of an album leaf structured in accordance with the invention.
Figure 2:
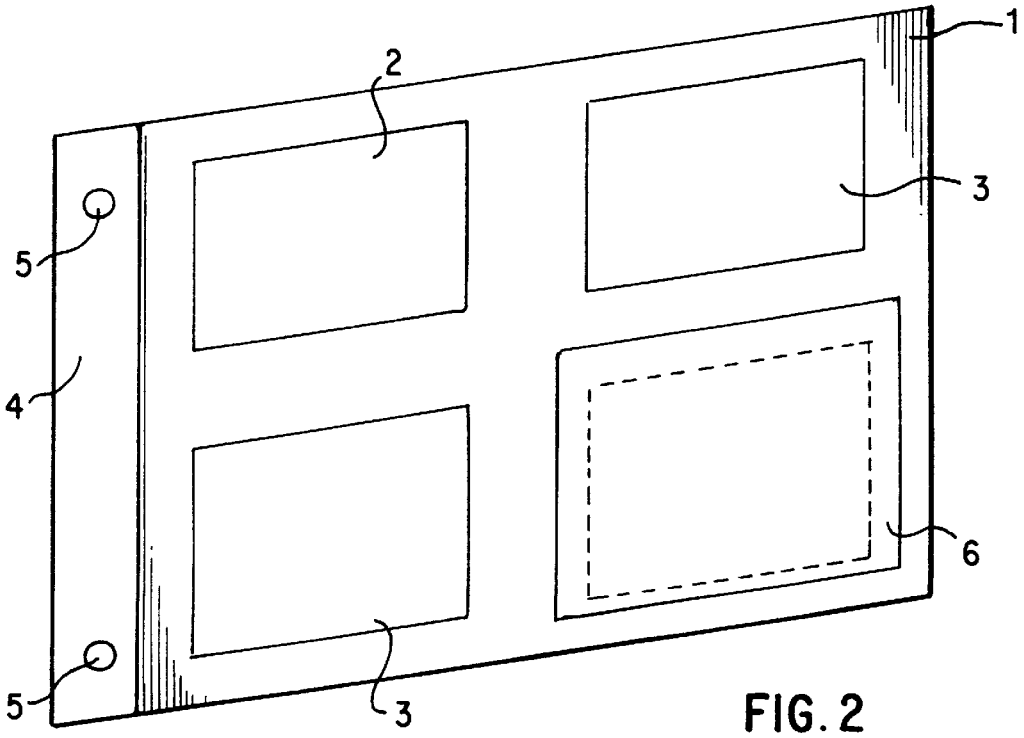
FIG. 2 is a variant of the album leaf according to FIG. 1.

FIG. 1 illustrates a view of a leaf of an album 1 structured in accordance with the invention. As an example, two planar rectangular areas which are covered by a layer 2 of an adhesive agent are arranged on the surface of the album leaf. Preferably, e.g. contact adhesives are used which allow a repeated removing and sticking on of the object to be mounted. These adhesive agent layers 2 are covered by a cover sheet 3. The cover sheet 3 includes preferably a layer which contains silicate and can, therefore, be easily removed completely from the adhesive agent layer 2. The cover sheet 3 is, thereby, advantageously dimensioned larger than the adhesive agent layer 2, so that the edge areas of the cover sheet 3 do not adhere on the adhesive agent layer 2. By means of this, removal of the cover sheet is greatly facilitated because its edges can quite easily be turned upwards, that is they can be gripped easily by the fingers under the edges. After the removal of the cover sheet 3 a planar picture, for instance a photograph 6, can be easily placed onto the adhesive agent layer 2 by a depositing and a pressing on, which photograph 6 remains thereafter clinging to mentioned layer, as illustrated in FIG. 2. Advantageously no additional adhesive agents or mounting devices are needed such as are necessary at conventional album leaves of simple paper or cardboard, Also, the partly tedious and difficult, task of inserting pictures in pockets formed by transparent foils is avoided of other known album foils.

Figure 4:
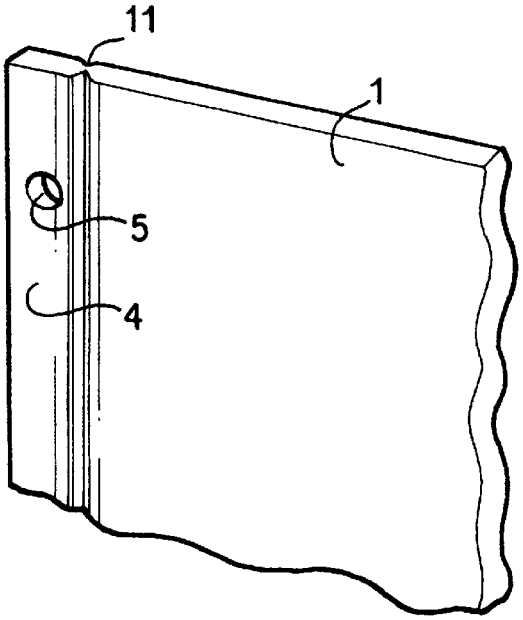
FIG. 4 is a view of a detail of an album leaf according a preferred embodiment according the present invention.
Figure 5:
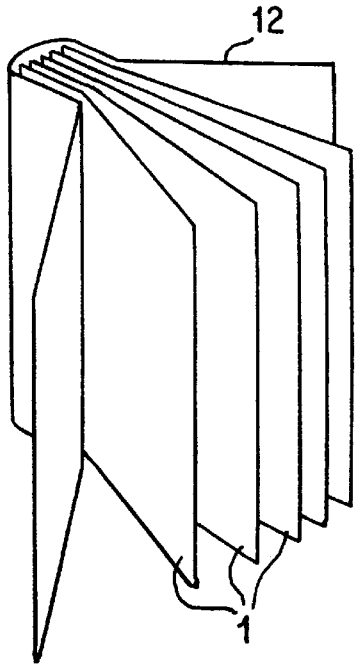
FIG. 5 is a view of an album consisting of album leafs according to the invention.

Obviously, the adhesive agent layers 2 with the covering release leaves 3 may be positioned advantageously at both sides of the album leaf 1. Such leaves can either be bound as commonly known to a bound book or be designed as single album leaves 1 having an edge area 4 including holes 5. The edge area 4 is, thereby, advantageously connected via a folding groove 11 to the album leaf 1, as illustrated in FIG. 4. Such album leaves can be placed into or received by, a binder 12, as illustrated in FIG. 5.

Figure 3:
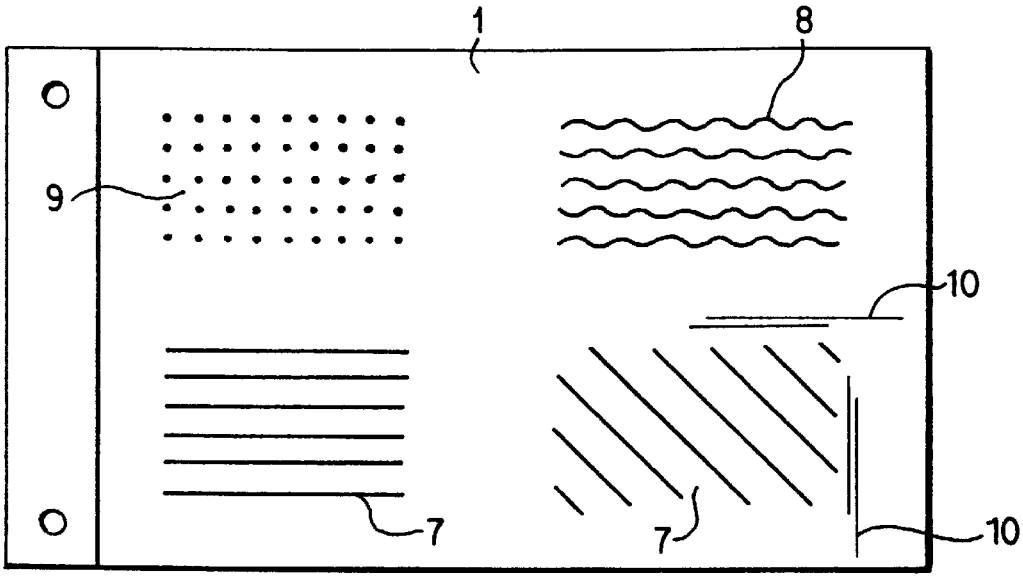
FIG. 3 is a further variant of the album leaf according to FIG. 1.

The adhesive agent areas 2 are advantageously not structured as rectangular areas which are completely covered by an adhesive agent, but can be shaped in a straight line 7, wave 8 or dot like manner 9 such as illustrated in FIG. 3. Such adhesive agent patterns can be easily deposited onto the album leaf by an apparatus having ejection nozzles for the adhesive agent. The arrangement of the adhesive agent areas 2 can, furthermore, be selected to suit the purpose of use on the album leaf, i.e. may encompass two, three or a plurality of areas having corresponding dimensions.

Preferably, positioning aids such as lines or markings 10 may be arranged adjacent the adhesive agent areas on the surfaces of the album foils which facilitate a positioning of the pictures parallel to the surface edges of the album leaves. For this reason these auxiliary lines and markings are arranged in parallel to these side edges.

While there are shown and described present preferred embodiments of the invention, it is to be distinctly understood that the invention is not limited thereto, but may be otherwise variously embodied and practiced within the scope of the following claims.

What is claimed is:

1. An album leaf for removably mounting a plurality of planar pictures, comprising:

a leaf having two sides;

a plurality of mounting areas of a non-permanent contact adhesive provided on one of the sides of the leaf, said plurality of mounting areas covering less than an entirety of said one of the sides; and a plurality of release cover sheets corresponding to said plurality of mounting areas, respectively, said release cover sheets covering said mounting areas and being detachable from the contact adhesive, said planar pictures being held exclusively by said non-permanent contact adhesive, said non-permanent contact adhesive allowing removal and replacement of said planar pictures, wherein each of said release cover sheets consists of a cellulose material and includes on at least one surface a layer which comprises silicon.

2. The album leaf of claim 1, wherein both sides of said album leaf are provided with said plurality of mounting areas of said contact adhesive and said plurality of release cover sheets.

3. The album leaf of claim 1, comprising at least three of said mounting areas of said contact adhesive.

4. The album leaf of claim 1, wherein the mounting areas of said contact adhesive are of a substantially rectangular shape.

5. The album leaf of claim 1, wherein said contact adhesive is arranged dot like on said at least one area of said leaf.

6. The album leaf of claim 1, wherein said contact adhesive is arranged on said at least one area of said album leaf in form of rectilinear or wave-shaped strips.

7. The album leaf of claim 1, wherein a strip having perforations is formed along one side edge of said leaf, said strip being adapted to be pivoted or bent along said side edge.

8. An album including a plurality of leaves as set forth in claim 1.

9. The album leaf of claim 4, wherein said mounting areas of said contact adhesive are of a smaller size than said planar pictures to be mounted on.

10. The album leaf of claim 1, wherein said cellulose material is paper.

* * * * *